US011773694B2

(12) United States Patent
Guelat et al.

(10) Patent No.: US 11,773,694 B2
(45) Date of Patent: Oct. 3, 2023

(54) POWER GENERATION FOR MULTI-STAGE WIRELESS COMPLETIONS

(71) Applicant: Schlumberger Technology Corporation, Sugar Land, TX (US)

(72) Inventors: Alain Guelat, Clamart (FR); Debasmita Basak, Pearland, TX (US); Dinesh Patel, Humble, TX (US); Christophe Rayssiguier, Clamart (FR); Bertrand Mancelle, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 64 days.

(21) Appl. No.: 17/621,279

(22) PCT Filed: Jun. 25, 2020

(86) PCT No.: PCT/US2020/039502
§ 371 (c)(1),
(2) Date: Dec. 21, 2021

(87) PCT Pub. No.: WO2020/264082
PCT Pub. Date: Dec. 30, 2020

(65) Prior Publication Data

US 2022/0356803 A1 Nov. 10, 2022

Related U.S. Application Data

(60) Provisional application No. 62/866,548, filed on Jun. 25, 2019.

(51) Int. Cl.

| | |
|---|---|
| ***E21B 23/03*** | (2006.01) |
| ***E21B 41/00*** | (2006.01) |
| ***E21B 47/13*** | (2012.01) |

(52) U.S. Cl.
CPC ..... *E21B 41/0085* (2013.01); *E21B 23/03* (2013.01); *E21B 47/13* (2020.05)

(58) Field of Classification Search
CPC ..... E21B 41/0085; E21B 23/03; E21B 47/13; F03B 13/02
See application file for complete search history.

(56) References Cited

U.S. PATENT DOCUMENTS 4,839,644 A 6/1989 Safinya et al.
5,457,988 A 10/1995 Delatorre
(Continued)

FOREIGN PATENT DOCUMENTS

EP 0681090 A2 11/1995
WO 2013090037 A1 6/2013
(Continued)

OTHER PUBLICATIONS

Manara, Production and reservoir management system, 2015 (2 pages).
(Continued)

*Primary Examiner* — Brad Harcourt
(74) *Attorney, Agent, or Firm* — Jeffrey D. Frantz

(57) ABSTRACT

Wireless multi-stage completions for providing power to and telemetry communication with downhole device(s) are provided. A power generation system can be disposed along a production string to power downhole devices. The power generation system can be driven by annulus fluid flow or production fluid flow and converts the fluid flow to electrical energy. The power generation system can be retrievably disposed in a side pocket mandrel.

19 Claims, 17 Drawing Sheets

(56) References Cited

U.S. PATENT DOCUMENTS

| | | | | |
|---|---|---|---|---|
| 5,839,508 | A | 11/1998 | Tubel et al. | |
| 6,515,592 | B1 | 2/2003 | Babour et al. | |
| 6,845,817 | B2 | 1/2005 | Schraub | |
| 7,133,325 | B2 | 11/2006 | Kotsonis et al. | |
| 7,902,955 | B2 | 3/2011 | Veneruso et al. | |
| 8,988,178 | B2 | 3/2015 | Deville et al. | |
| 9,284,834 | B2 | 3/2016 | Alteirac et al. | |
| 10,408,020 | B2 | 9/2019 | Rajagopalan et al. | |
| 10,473,501 | B2 | 11/2019 | Parry et al. | |
| 11,028,667 | B2 | 6/2021 | Arsalan et al. | |
| 2005/0051323 | A1* | 3/2005 | Fripp | E21B 41/0085 166/65.1 |
| 2005/0139393 | A1 | 6/2005 | Maurer et al. | |
| 2007/0079989 | A1 | 4/2007 | Bankston et al. | |
| 2008/0007425 | A1 | 1/2008 | Hall et al. | |
| 2008/0156477 | A1* | 7/2008 | Aivalis | E21B 41/0085 166/53 |
| 2011/0186290 | A1* | 8/2011 | Roddy | E21B 47/09 166/253.1 |
| 2013/0321165 | A1* | 12/2013 | Johannessen | G01V 3/18 340/854.4 |
| 2014/0174733 | A1* | 6/2014 | Gadot | E21B 41/0085 166/264 |
| 2016/0087271 | A1 | 3/2016 | Jarvis et al. | |
| 2017/0362953 | A1 | 12/2017 | Gatzen et al. | |
| 2018/0155991 | A1 | 6/2018 | Arsalan et al. | |
| 2018/0313196 | A1* | 11/2018 | Frantz, III | F04B 47/06 |
| 2021/0222522 | A1* | 7/2021 | Greci | E21B 47/01 |

FOREIGN PATENT DOCUMENTS

| | | | |
|---|---|---|---|
| WO | 2020023825 | A1 | 1/2020 |
| WO | 2020263961 | A1 | 12/2020 |
| WO | 2022006420 | A1 | 1/2022 |

OTHER PUBLICATIONS

WellWacher Flux, Multizonal reservoir monitoring system, 2016 (2 pages).

International Search Report and Written Opinion issued in the PCT Application PCT/US2021/040127, dated Oct. 25, 2021 (10 pages).

International Search Report and Written Opinion issued in the PCT Application PCT/US2020/039502, dated Oct. 7, 2020 (14 pages).

* cited by examiner

POWER GENERATION FOR MULTI-STAGE WIRELESS COMPLETIONS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/866,548, filed Jun. 25, 2019, the entirety of which is incorporated by reference herein and should be considered part of this specification.

BACKGROUND

Field

The present disclosure relates to monitoring and control of subsurface installations located in one or more reservoirs of fluids such as hydrocarbons, and more particularly to methods and installations for providing wireless transmission of power and communication signals to, and receiving communication signals from, those subsurface installations.

Description of the Related Art

Reservoir monitoring includes the process of acquiring reservoir data for purposes of reservoir management. Permanent monitoring techniques are frequently used for long-term reservoir management. In permanent monitoring, sensors are often permanently implanted in direct contact with the reservoir to be managed. Permanent installations have the benefit of allowing continuous monitoring of the reservoir without interrupting production from the reservoir and providing data when well re-entry is difficult, e.g. subsea completions.

Permanent downhole sensors are used in the oil industry for several applications. For example, in one application, sensors are permanently situated inside the casing to measure phenomenon inside the well such as fluid flow rates or pressure.

Another application is in combination with so-called smart or instrumented wells with downhole flow control. An exemplary smart or instrumented well system combines downhole pressure gauges, flow rate sensors and flow controlling devices placed within the casing to measure and record pressure and flow rate inside the well and adjust fluid flow rate to optimize well performance and reservoir behavior.

Other applications call for using sensors permanently situated in the cement annulus surrounding the well casing. In these applications, formation pressure is measured using cemented pressure gauges; distribution of water saturation away from the well using resistivity sensors in the cement annulus; and seismic or acoustic earth properties using cemented geophones. Appropriate instrumentation allows other parameters to be measured.

These systems utilize cables to provide power and/or signal connection between the downhole devices and the surface. The use of a cable extending from the surface to provide a direct to connection to the downhole devices presents a number of well-known advantages.

There are however, a number of disadvantages associated with the use of a cable in the cement annulus connecting the downhole devices to the surface including: a cable outside the casing complicates casing installation; reliability problems are associated with connectors currently in use; there is a risk of the cable breaking; the cable needs to be regularly anchored to the casing with cable protectors; the presence of a cable in the cement annulus may increase the risk of an inadequate hydraulic seal between zones that must be isolated; added expense of modifications to the wellhead to accommodate the feed-through of large diameter multi-conductor cables; the cables can be damaged if they pass through a zone that is perforated and it is difficult to pass the cable across the connection of two casings of different diameters.

In efforts to alleviate these and other disadvantages of downhole cable use, so-called "wireless systems" have been developed.

SUMMARY

Systems and methods for downhole power generation for wireless multi-stage completions are provided.

In some configurations, a power generation system includes a turbine driven by fluid flow; an alternator driven by the turbine, the alternator configured to convert energy from the fluid flow to electrical energy; an electrical power storage device configured to be charged by the electrical energy generated from the fluid flow; and a connector configured to transfer power from the storage device to a device requiring electrical power outside the power generation system. The power generation system is configured to be removably disposed in a side pocket mandrel in a wellbore.

The turbine can be driven by annulus fluid flow. The turbine can be driven by a portion of production fluid flow. The connector can be an inductive coupler or a wet mate connector. The power storage device can be a rechargeable battery. In some such configurations, the connector is an inductive coupler, and when disposed in a well, the rechargeable battery is configured to be charged via inductive charging by a wireline tool including an inductive coupler lowered into the well to a position in which the inductive coupler of the wireline tool is aligned (e.g., radially aligned) with the inductive coupler of the power generation system. The power generation system can be configured to be disposed in and/or removed from the side pocket mandrel by wireline or slickline. The power generation system can include a fishing profile configured to couple to a kick-over tool installed on or in the wireline or slickline string.

In some configurations, a side pocket mandrel is configured to house a power generation system. The side pocket mandrel includes an elongate body defining a main bore; an internal wall disposed in the main bore and defining a side pocket, the side pocket configured to house the power generation system, the internal wall having a large opening configured to allow fluid to flow from the main bore, through the opening, and along the power generation system in the side pocket; and an electrical connector disposed at a bottom of the side pocket.

The electrical connector can include an inductive coupling coil. The coil can inductively couple with a coil of a power generation system disposed in the side pocket in use. The electrical connector can include an electrical conductor for direct physical contact. A power generation system as described herein can be disposed in the side pocket.

In some configurations, a power generation system includes a power generator driven by fluid flow and configured to convert energy from the fluid flow to electrical energy; an electrical power storage device configured to be charged by the electrical energy generated from the fluid flow; and a connector configured to transfer power from the power storage device to a device requiring electrical power outside the power generation system. The power generation system is configured to be removably disposed in a wellbore, for example, in a tubing string deployed in a wellbore.

The power generator can be a turbine. The connector can be a first coil of an inductive coupler pair. The power generator can be driven by annulus fluid flow. The power generator can be driven by a portion of production fluid flow. A well completion can include a tubing string, the power generation system disposed within the tubing string, and a second coil of the inductive coupler pair disposed within the tubing string such that the first and second coils of the inductive coupler pair are radially aligned when the power generation system is disposed within the tubing string.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
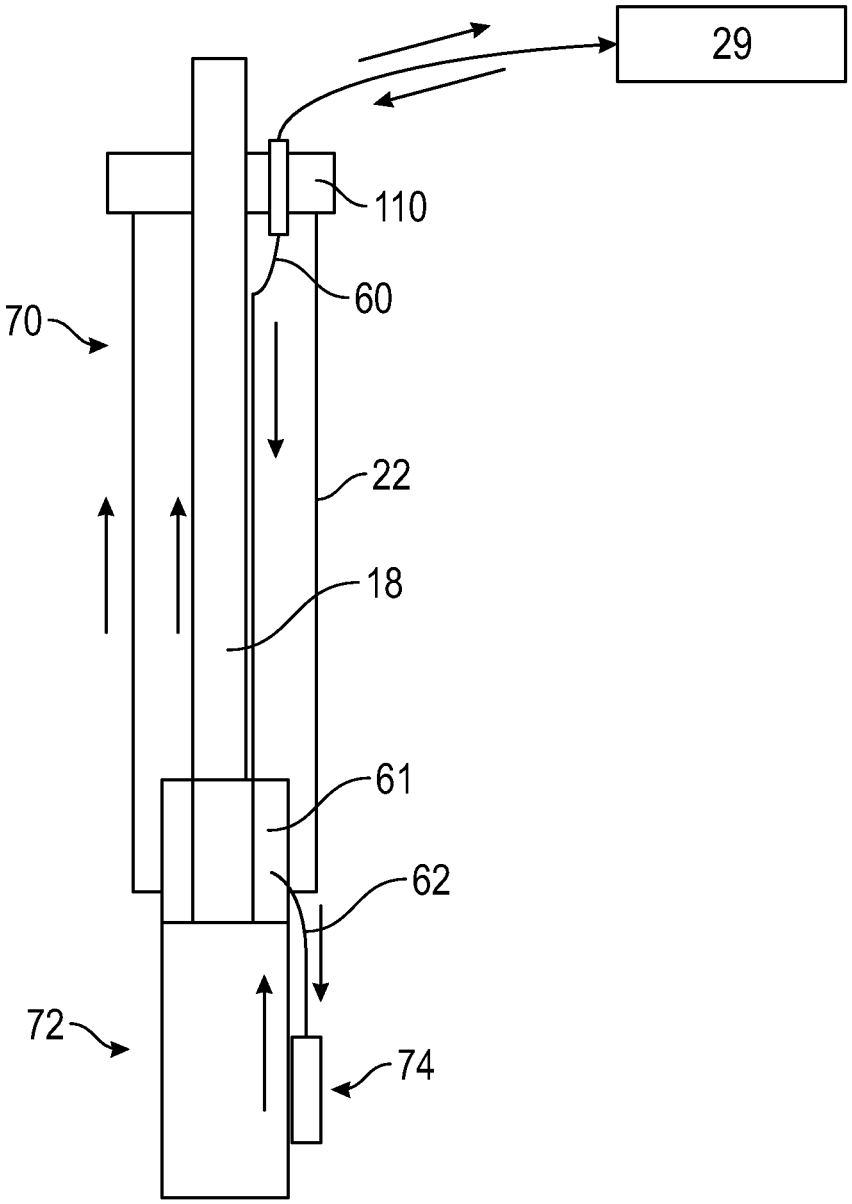
FIG. 1 illustrates an example of a wired multi-stage completion.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

After being drilled and tested, a production well receives a permanent completion, i.e., the production string where effluent flows in use. If the completion is damaged or maintenance is required, the completion can be removed and replaced, but doing so is expensive and often requires a rig. Therefore, components of the completion are expected to have a long lifespan (typically more than 10 years). However, some existing electrical components, such as batteries, do not have sufficiently long lifespans. Many wells include electronic devices for downhole measurements. Traditionally, the link for power and data transmission between the surface and downhole tools and devices was an electric cable. Newer techniques, for example using acoustic or electro-magnetic transmission, allow for wireless communication, which can simplify installation and improve reliability. Such techniques are often used for short durations (for example, up to several weeks), such as during testing operations. However, the size, cost, and short life expectancy of batteries used to power electronic devices in wireless systems are problematic.

FIG. 1 illustrates a wired multi-stage completion for providing power to and telemetry communication with downhole device(s), for example, for reservoir monitoring and control. As shown, the system includes an upper completion 70 and a lower completion 72. The lower completion 72 includes various reservoir monitoring and control tools 74. As shown, the upper completion includes a tubing hanger 110 supporting production tubing 18. In use, power and telemetry current flows from a surface power and telemetry system 29 through a cable 60, which extends through the tubing hanger 110 to an inductive coupler pair 61. The inductive coupler pair 61 can be positioned at or near a bottom of the upper completion 70 or at or near a junction of the upper completion 70 and the lower completion 72. Power flows from the inductive coupler pair 61 to the tools 74 along a cable 62. Telemetry signals can also flow to and from the tools 74 along cable 62.

Figure 2:
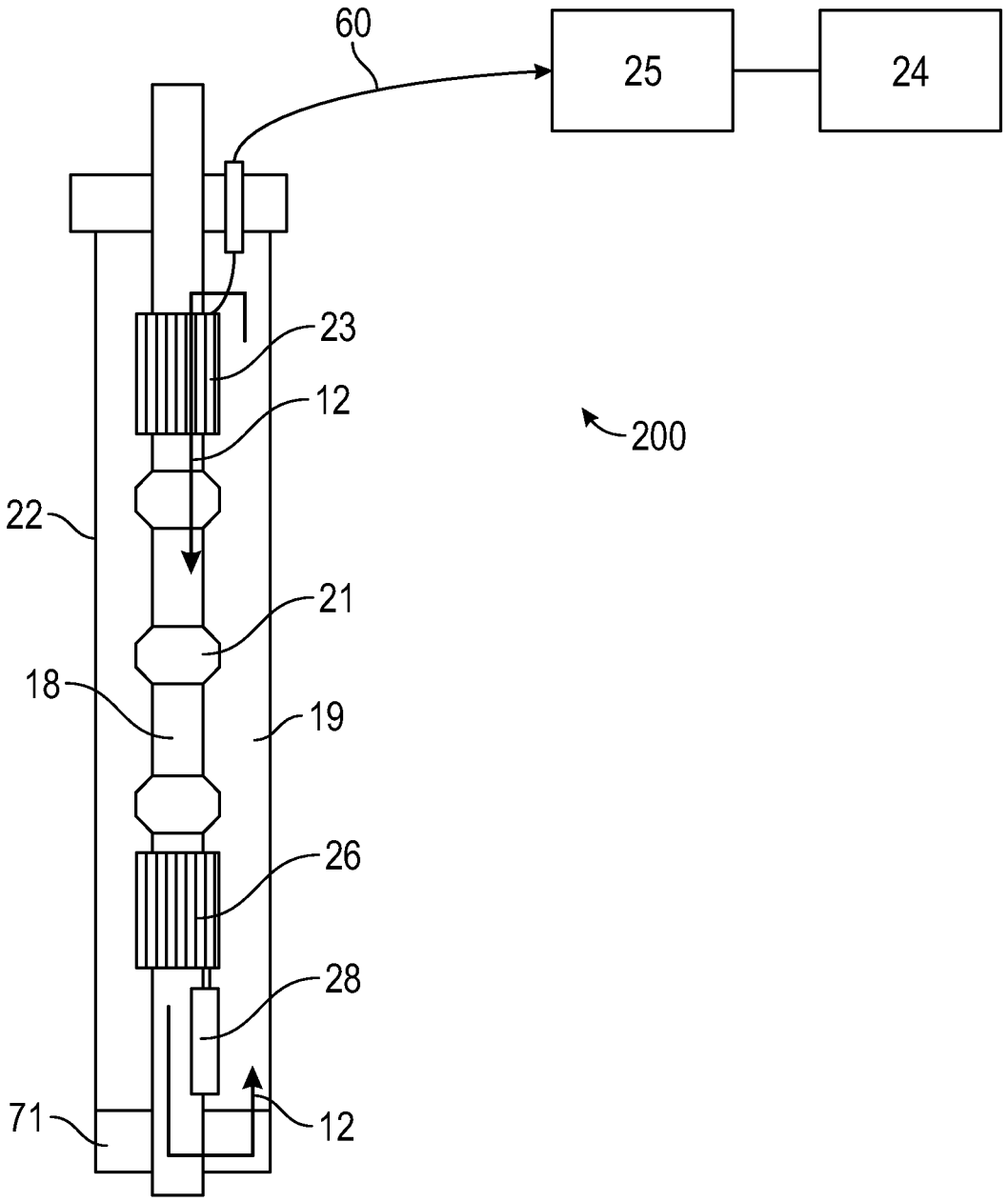
FIG. 2 illustrates an example wireless transmission system.

FIG. 2 illustrates an example of a wireless transmission system 200 or tubing-casing transmission system, in which an insulated system of tubing and casing serve as a coaxial line. Additional details regarding such a tubing-casing transmission system can be found in U.S. Pat. Nos. 4,839,644 and 6,515,592, each of which is hereby incorporated herein by reference. Both power and two-way communication (telemetry) signal transmission are possible in the tubing-casing system.

In the example of FIG. 2, tubing 18, e.g., production tubing, is installed in a casing string 22. In use, injected current flows along current lines 12, with the tubing 18 serving as the conductive conduit and the casing 22 serving as the return path for electrical signal(s) flowing along current lines 12, providing power transmission to and/or communication with one or more downhole devices 28. The tubing 18 is electrically isolated from the casing 22 by, for example, non-conductive or insulating fluid 19 in the interior annulus (the space between the tubing 18 and casing 22), non-conductive or insulating centralizers 21 disposed about the tubing 18, and/or an insulating coating on the tubing 18. A conductive packer 71 establishes an electrical connection between the tubing 18 and the casing 22 for the electrical signal return path.

An upper coupler or toroidal transformer 23 is linked to a surface modem and power supply 24 by a cable 60. In use, current is injected into upper coupler 23 from source 24 through the cable 60, thereby inducing a current in tubing 18. The induced current flows along current paths 12 through the tubing to a lower coupler or toroidal transformer 26. The induced current flowing through the tubing 18 inductively generates a voltage in the lower coupler 26 that is used to provide power and/or communication to the downhole device(s) 28. Communication signals from the downhole device(s) 28 induce a second voltage in the lower coupler 26, which creates a second current. The second current flows along current paths 12 from the lower coupler 26, through the tubing 18, through the conductive packer 71, and along the return path through the casing 22 to a surface electronic detector 25 to be recorded, stored, and/or processed.

The present disclosure provides wireless transmission systems and methods for providing power to and/or communication with one or more permanent downhole devices 28 or tools (e.g., downhole valves, flow control devices, sensors (for example, a formation evaluation system, a pressure/temperature monitoring system, and acoustic or electro-magnetic transmitter), packers, downhole tool setting modules, downhole isolation devices, and/or anchoring devices) in multi-stage completions. In some such systems and methods, the casing 22 is deployed in the well, then the tubing 18 is deployed within the casing 22 in separated runs, leading to a multi-stage completion. Similar to the system 200 of FIG. 2, the tubing 18 and casing 22 in systems for wireless multi-stage completions can serve as a coaxial line for transmission of power and telemetry signals. The present disclosure provides systems and methods to harvest power at the bottom of an upper completion so that there is no need for wires between the surface or subsurface system and the interface between upper and lower completions. The harvested power can advantageously be used to generate telemetry signals from downhole devices for wireless telemetry using electro-magnetic or acoustic wave propagation.

Figure 3:
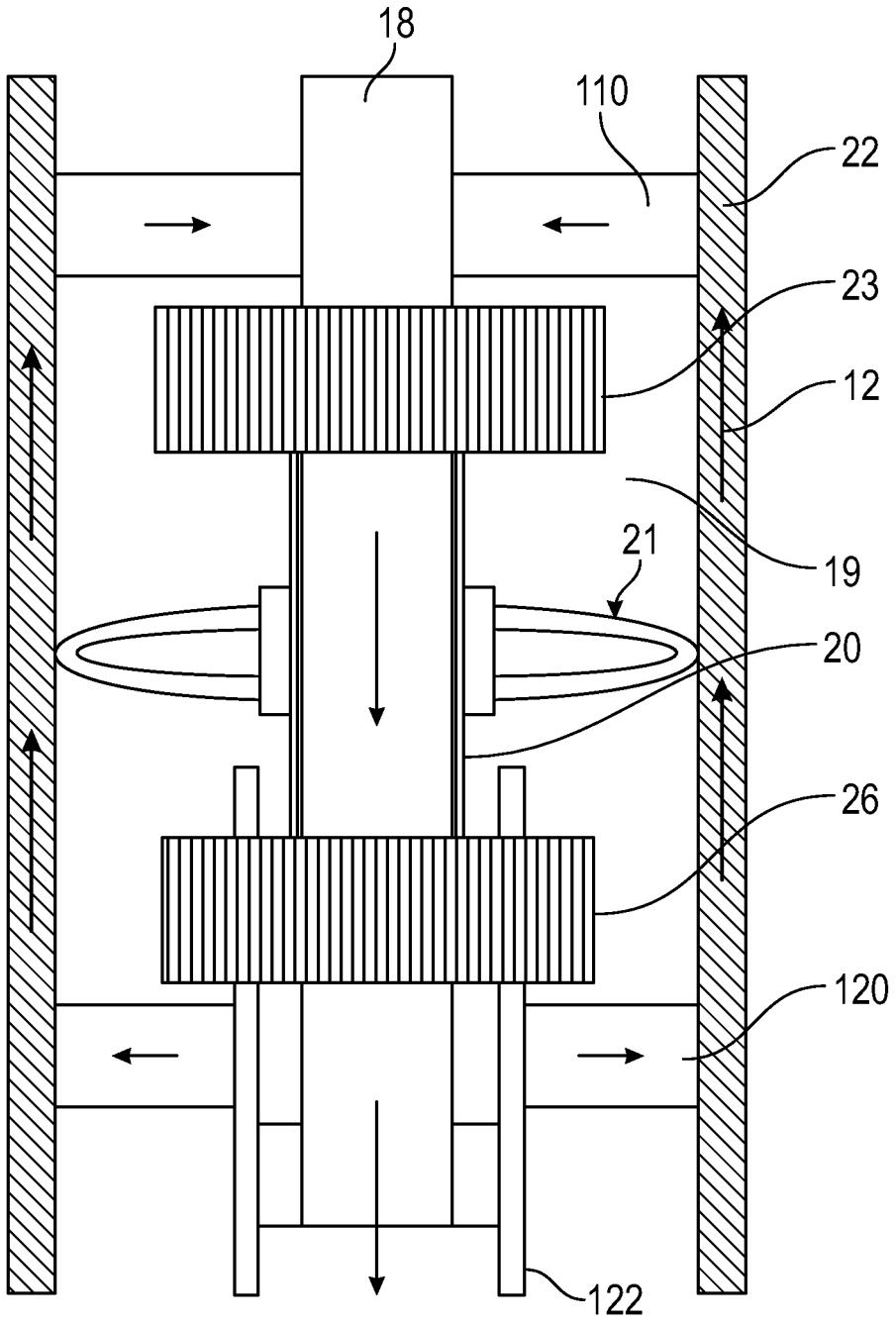
FIG. 3 illustrates an example multi-stage wireless transmission system.

FIG. 3 illustrates an example of a multi-stage wireless transmission system. A tubing hanger 110 at or near the top of the production string or in the upper completion supports the tubing 18. The tubing hanger 110 and/or an upper production packer also acts as an upper section short between the casing 22 and tubing 18. A liner hanger 120 provides attachment for and/or supports the production liner 122 for the lower completion. The liner hanger 120 and/or a lower production packer act as a lower section short between the tubing 18 and the casing 22. The upper section short and lower section short close the tubing-casing system current loop.

As shown, the tubing 18 can be at least partially coated with an insulating coating (e.g., a polyamide material (Rilsan type)) 20, an insulating fluid 19 can be disposed in the annular space, and/or non-conductive or insulating centralizers 21 can be disposed about the tubing 18. Couplers or toroidal transformers 23, 26 provide electrical coupling between the tubing-casing transmission line and the surface and/or downhole device(s). The couplers 23, 26 are or include toroidal transformers electrically coupled to the tubing-casing line for receiving and/or transmitting power and/or telemetry signals.

In the illustrated configuration, the multi-stage wireless transmission system includes an upper coupler 23 and a lower coupler 26. The upper coupler 23 is driven by surface electronics (e.g., AC power supply and control electronics, such as source 24 and detector 25). The upper coupler 23 can transmit and detect low frequency signals (e.g., AC current) propagating along the pipe to the lower coupler 26. The lower coupler 26 is connected to downhole electronics, e.g., downhole device(s) 28, for detection of telemetry signals, recovery of electrical power, and/or uplink data transmission. The lower completion can also include a battery or any type of energy storage device. Any type(s) of modulation/demodulation technique(s) (e.g., FSK, PSK, ASK) can be used for communication between the upper 23 and lower 26 couplers. Multi-stage wireless transmission systems and methods according to the present disclosure therefore establish wireless communication between lower and upper sections of the production string.

Figure 4:
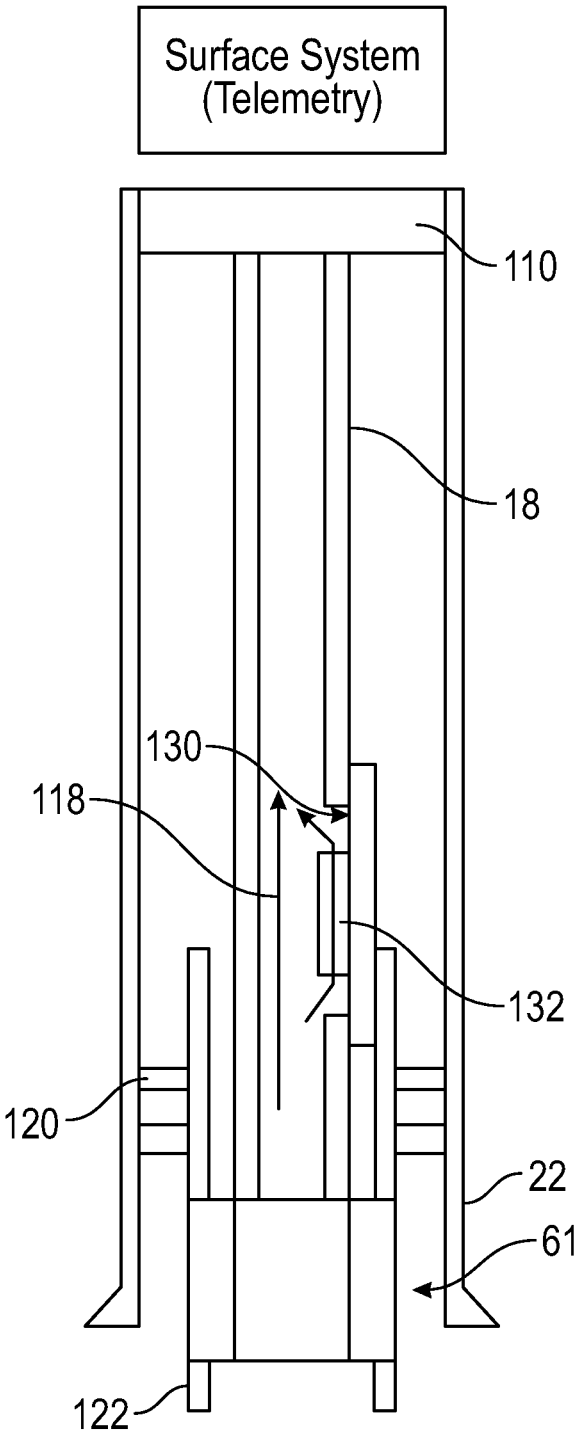
FIG. 4 illustrates an example of a wireless multi-stage completion system powered by a downhole generator.

An example of a wireless multi-stage completion system powered by a downhole generator is shown in FIG. 4. A tubing hanger 110 at or near the top of the production string or in the upper completion supports the tubing 18. A liner hanger 120 provides attachment for and/or supports the production liner 122 for the lower completion. The system includes a power generation system 132 proximate the bottom of the upper completion and/or proximate a junction between the upper completion and lower completion. In the illustrated configuration, the power generation system 132 is powered by the energy of production fluid flow (along flow lines 118) within the tubing 18. In other words, the power generation system 132 harvests energy from the production fluid flow and converts that energy to, or produces, electrical current. Because power for the lower completion is generated by the power generation system 132, wires for delivering power from the surface to the lower completion are not required, and the tubing hanger 110 does not require penetrations for power supply. The power generated by the power generation system 132 can be used to power, for example, downhole valves, flow control devices, sensors, packers, downhole tool setting modules, downhole isolation devices, anchoring devices, formation evaluation systems, pressure/temperature monitoring systems, acoustic transmitters, and/or electro-magnetic transmitters.

Turbines as traditionally used during drilling may not be reliable for very long durations. The effluent contains solid particles, such as sand or debris, and paraffin or other chemical products that can eventually block the turbine. Additionally, batteries deployed downhole and powered by the turbines are exposed to high temperatures, and therefore have a limited life expectancy and must be replaced after several years. The present disclosure provides systems and methods for installing components that may require maintenance (e.g., the turbine, one or more batteries) in a compact package that can be retrieved and replaced with light operations not requiring a rig, e.g., with slick-line or wireline.

In some configurations, the power generation system 132 is disposed in a side pocket 130 of the tubing 18, for example, a side pocket 130 of a side pocket mandrel disposed along the tubing 18 string, positioned proximate the bottom of the upper completion and/or proximate the junction between the upper completion and lower completion. The side pocket 130 can be a recessed area of an inner surface of the tubing 18 wall or side pocket mandrel wall, or a portion of the tubing wall 18 (or side pocket mandrel wall) and/or flow path through the tubing 18 (or side pocket mandrel) that is offset radially outward from a central longitudinal axis of the tubing 18 compared to the rest of the wall or flow path. The power generation system 132 can be retrievable from and/or re-seatable in the side pocket 130, for example, with light workover using wireline, coiled tubing, and/or any other appropriate conveyance technology. The power generation system 132 can also be serviced in place, for example, with through-tubing intervention.

The system can also include one or more batteries and associated circuitry that accumulate and/or store the energy produced by the power generation system 132. The one or more batteries can be located in or proximate the power generation system 132, for example, in the side pocket 130. The one or more batteries can be considered part of the power generation system 132. The one or more batteries allow the stored energy to be available during production shutdown. The one or more batteries can be rechargeable. In other configurations, the one or more batteries can be non-rechargeable. In some such configurations, the one or more batteries may supply power only during production shutdown, and be on standby otherwise, e.g., during production. The one or more batteries can be retrievable from and/or re-seatable, for example, with light workover using wireline, coiled tubing, and/or any other appropriate conveyance technology. The ability of the batteries to be retrieved and re-seated can advantageously allow for a longer life span or period of operation (e.g., ten years or more) with regular maintenance workover even though current turbo-alternator and battery technologies may only have a lifetime of a few years in downhole environments.

Figure 5:
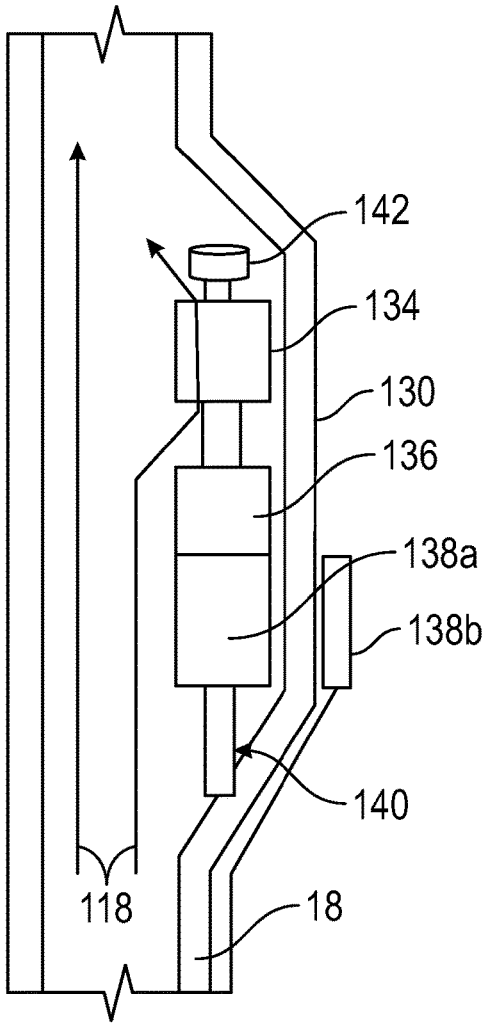
FIG. 5 illustrates a power generation system of the system of FIG. 4.

FIG. 5 shows the power generation system 132 in more detail. The power generation system 132 can be anchored in the side pocket 130 with a mechanical anchoring mechanism 140. The anchoring mechanism 140 allows the power generation system 132 to be installed after the initial installation of the completion and to be replaced by a new module when needed during the lifespan of the well. The power generation system 132 can also include a fishing profile 142 to assist with retrieving the system 132 when needed. As shown, the power generation system 132 includes a power generator 134 and a power storage and conversion unit 136. The power storage and conversion unit 136 can include one or more batteries, a power rectifier, and inverter electronics. The power generation system 132 also includes one inductive coupler 138*a* of an inductive coupler pair 138, with the other coupler 138*b* of the inductive coupler pair 138 located on an outside of the side pocket 130 or of the tubing 18. In use, the power storage and conversion unit 136 drives the inductive coupler pair 138 to power the lower completion.

The power generator 134 can employ various technologies. For example, the power generator 134 can include a turbine that is driven by fluid (e.g., production fluid) flow and that drives an alternator in rotation (in other words, a turbo-alternator). The alternator can then charge associated batteries. In some configurations, the power generator 134 includes piezo flappers or wings. The kinetic energy of the production fluid flow causes motion of wings or flappers covered with piezo-electric materials, thereby creating an output voltage that drives a conversion circuit. The power generator 134 can include a ball with a magnet that is spun by a vortex effect and generates current by induction. This configuration can be similar to a turbo-alternator, with the turbine replaced by a sphere that has many magnetic poles and that spins in close proximity to wire coils, in which induced current flows. As another example, the power generator 134 can include one or more arrays of mini-spinners. The mini-spinners are small turbines powered by the production fluid flow to generate power. Compared to a turbo-generator, the mini-spinners allow power generation to be distributed over a large number of mini-spinners, and the mini-spinners may be a simpler component than the turbo-alternator (e.g., having mud lubricated bearings and/or low rotation speed).

Figure 6:
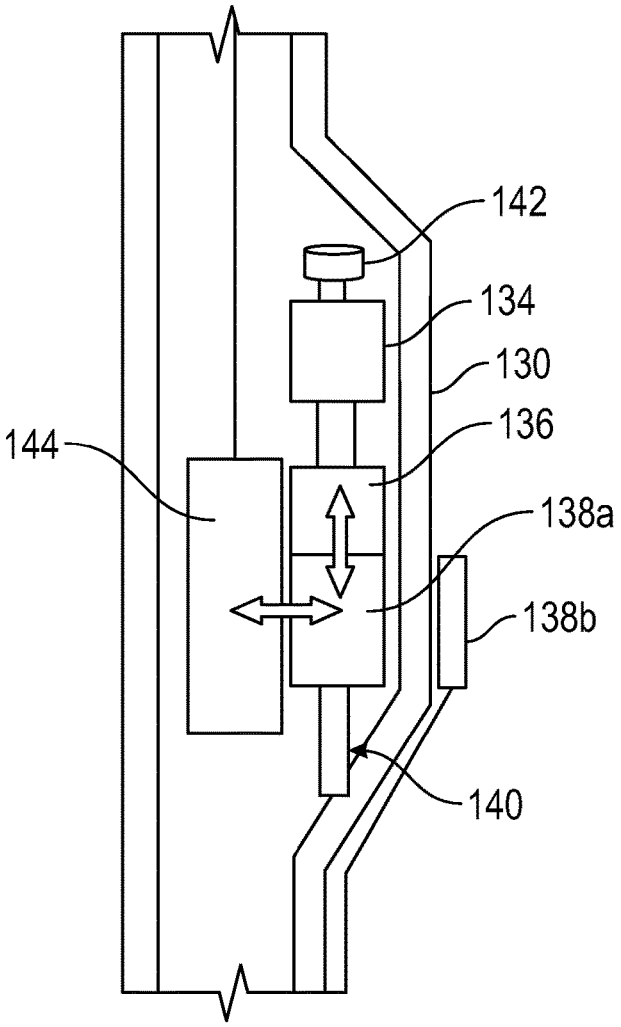
FIG. 6 illustrates powering or recharging the power generation system of FIG. 5 using a wireline conveyance.

In configurations in which the power storage and conversion unit 136 includes rechargeable batteries, the power generation system 132 can be powered or recharged via a coiled tubing conveyance or a wireline conveyance as shown in FIG. 6. As shown, a wireline tool 144 including an inductive coupler can be lowered into the well to a position in which the inductive coupler of the wireline tool 144 is aligned with the inductive coupler 138*a* of the power generation system 132 to charge the batteries of the power storage and conversion unit 136 via inductive charging.

As described herein, challenges with existing downhole turbine power generators include limited longevity or lifespan, and exposure to high flow rates in use, which can lead to premature failure. Power generation systems 132, or portion(s) thereof, according to the present disclosure can be retrievable from and/or re-seatable in the tubing 18, e.g., the side pocket 130. This can advantageously allow for a longer life span or period of operation (e.g., ten years or more) with regular maintenance workover even though current turbo-alternator and battery technologies may only have a lifetime of a few years in downhole environments. The present disclosure also provides features and methods to limit flow to a downhole turbine power generator. Power generators according to the present disclosure can be connected to a downhole wired or wireless connector. The power generator can be used to power downhole tools or devices, for example, downhole valves, flow control devices, sensors, packers, downhole tool setting modules, downhole isolation devices, and/or anchoring devices. The power generator can be used to charge downhole batteries, which can power downhole tools.

Figure 7:
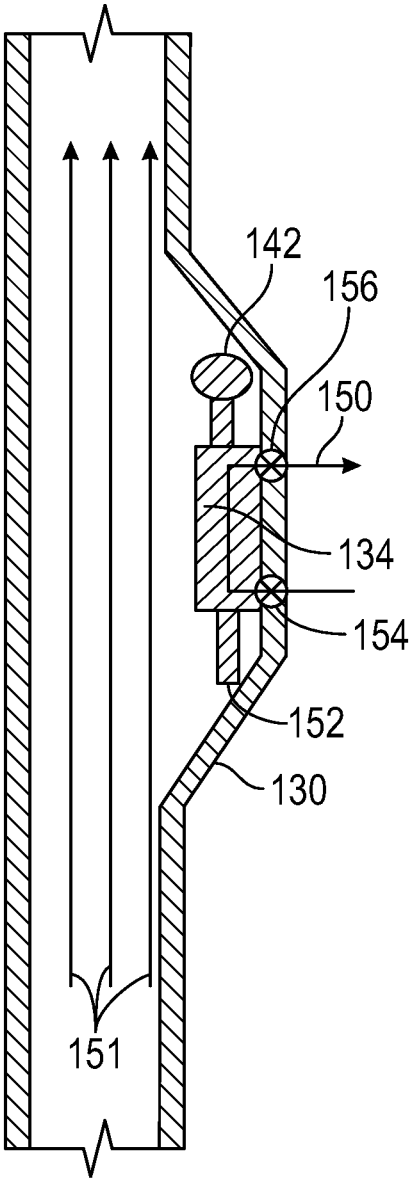
FIG. 7 illustrates an example annulus fluid driven retrievable downhole turbine power generation system.

FIG. 7 illustrates an example power generation system 132 in which the power generator 134 is an annulus fluid driven turbine. In use, the power generation system 132 harvests energy from annulus fluid flow, indicated by line 150. The power generation system 132 uses the energy from the annulus fluid flow to produce, or converts the energy from the annulus fluid flow to, electrical current.

In the illustrated configuration, the power generation system 132 is disposed in a side pocket 130, which allows the power generation system 132, or portion(s) thereof, to be retrievable and re-seatable using light workover using wireline, coiled tubing, or any other suitable conveyance technology. The power generation system 132 can include a fishing profile 142 as shown to assist with retrieving the system 132 when needed. The power generation system 132 includes a connector 152 to connect the power generation system 132 to downhole equipment, such as a downhole power and telemetry bus system. The connector 152, and connection between the connector and downhole equipment, can be wired or wireless.

The power generation system 132 is positioned below the production packer in one or more zones with active flow. The side pocket 130 and/or power generation system 132, e.g., the power generator or turbine 134, includes an inflow port 154 and an outflow port 156. As indicated by line 150, reservoir or annulus fluid flows into the tubing 18 and power generation system 132, e.g., the turbine 134, through inflow port 154, through the power generation system 132, and out of the power generation system 132 and tubing 18 through outflow port 156. The inflow 154 and outflow 156 ports can be actively or passively controlled to provide a controlled amount of fluid flowing through the turbine. The annulus fluid flowing into and out of the turbine is isolated from the production fluid 151 flowing in the main bore of the production tubing 18 with isolation mechanism, such as seals. The power generator 134 is therefore isolated from production fluid flow 151 both mechanically and hydraulically.

Figure 8:
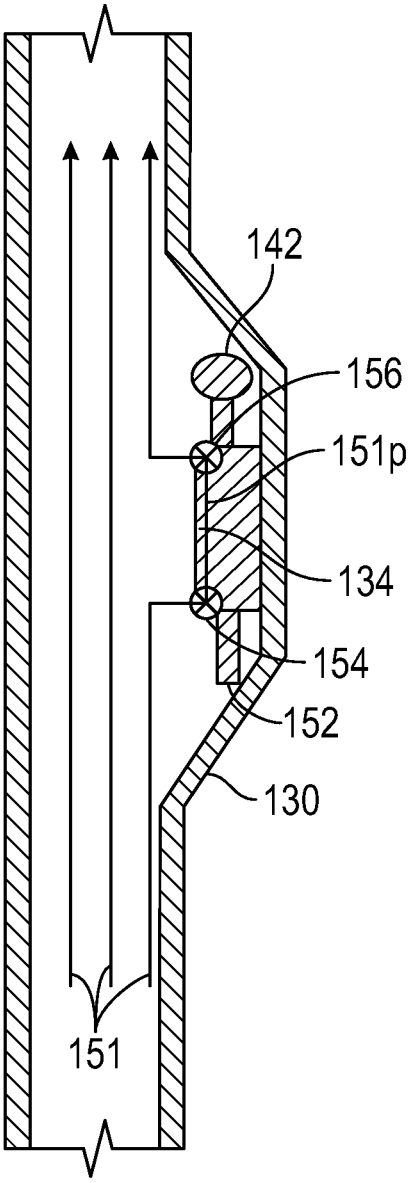
FIG. 8 illustrates an example production fluid driven retrievable downhole turbine power generation system.

FIG. 8 illustrates an example power generation system 132 in which the power generator 134 is a production fluid driven turbine. In use, the power generation system 132 harvests energy from production fluid flow, or a portion or fraction thereof, indicated by lines 151. The power generation system 132 uses the energy from the production fluid flow to produce, or converts the energy from the production fluid flow to, electrical current.

Like the embodiment of FIG. 7, the power generation system 132 is seated in a side pocket 130, which allows the power generation system 132, or portion(s) thereof, to be retrieved and re-seated. The power generation system 132 of FIG. 8 also includes a fishing profile 142 and connector 152 to connect, with a wired or wireless connection, to downhole equipment, such as a downhole power and telemetry bus system.

The power generation system 132 of FIG. 8 can be located anywhere in the completion string where active tubing 18 (production) fluid flow is available. The power generation system 132, or power generator, e.g., turbine, 134, includes an inflow port 154 and an outflow port 156. As indicated by line 151*p*, a portion of the production fluid flows into the power generation system 132, e.g., into the turbine 134, through inflow port 154, through the power generation system 132, e.g., the turbine 134, and out of the power generation system 132, e.g., the turbine 134, through outflow port 156. The inflow 154 and outflow 156 ports can be actively or passively controlled to provide a controlled amount of fluid flowing through the turbine. This helps ensure the turbine is not exposed to the high flow rate of the production fluid flowing through the main body of the tubing 18.

Figure 9:
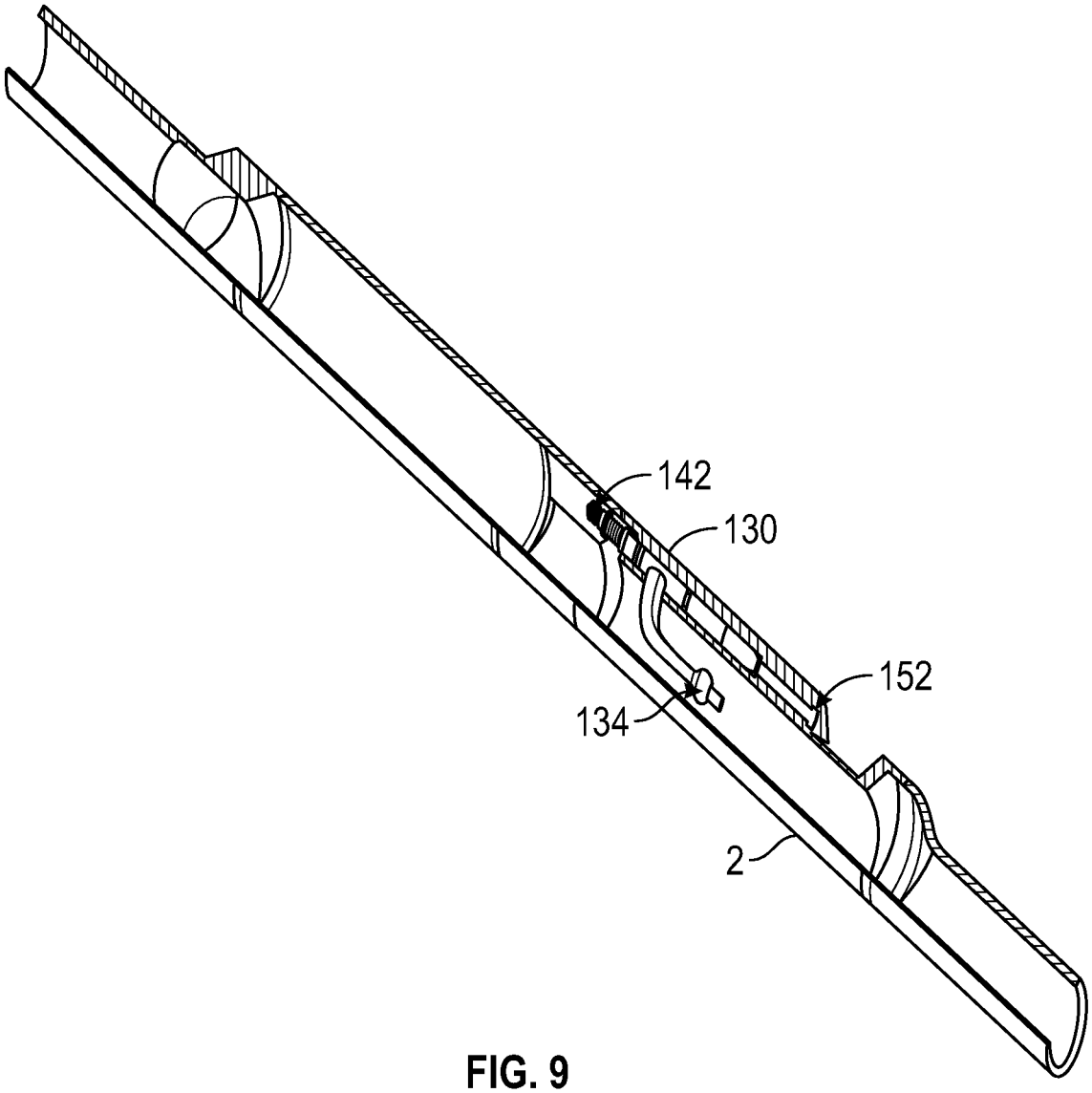
FIG. 9 illustrates another example production fluid driven retrievable downhole turbine power generation system.
Figure 10:
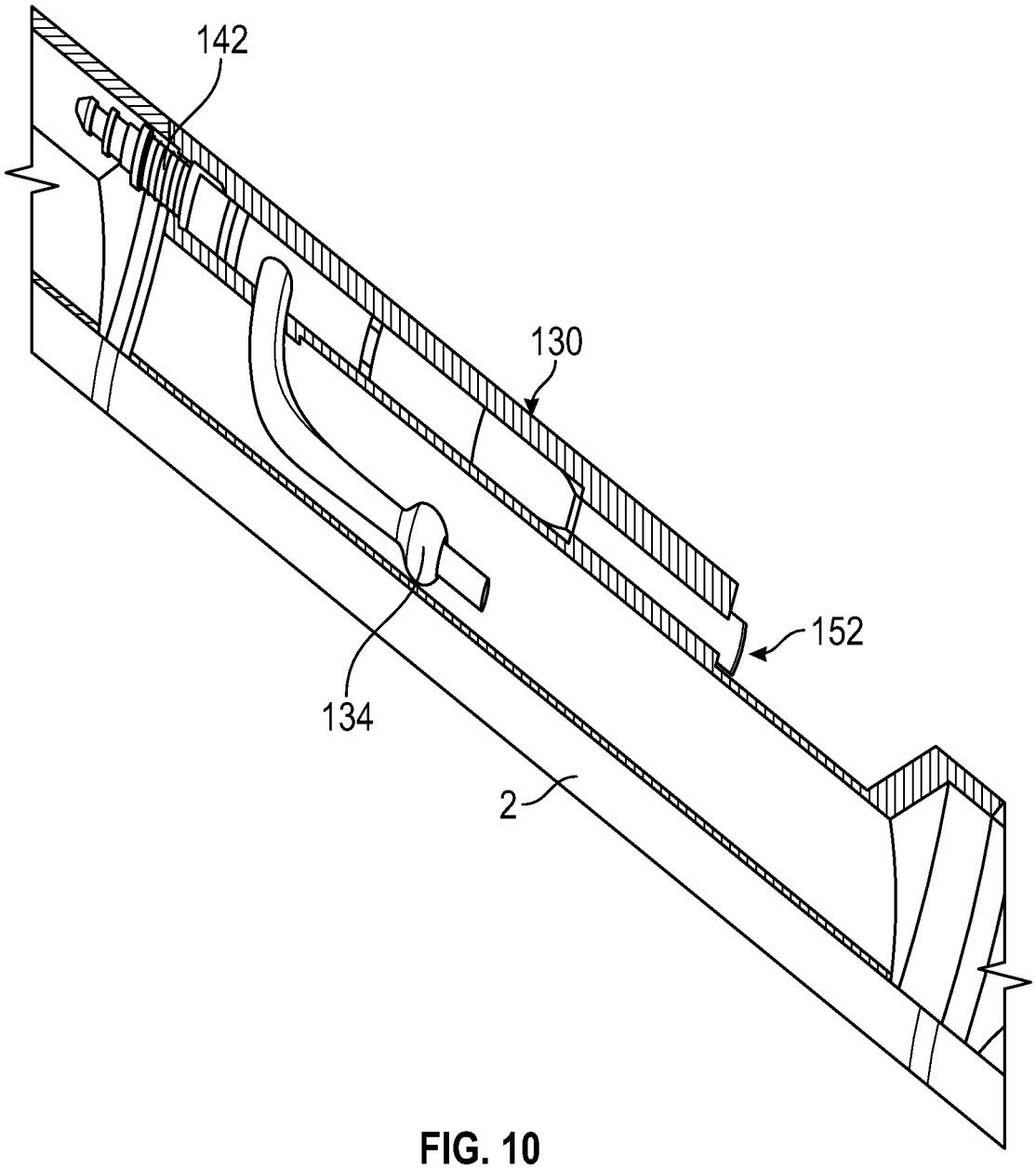
FIG. 10 is a close-up of the system of FIG. 9.

FIGS. 9 and 10 illustrate an alternative design for a power generation system 132 in which the power generator 134 is a production fluid driven turbine. Like previous embodiments, the power generation system 132 includes a power generator 134, a fishing profile 142, and a connector 152 for connecting to one or more downhole devices, e.g., a downhole power and telemetry bus system, via a wired or wireless connection. Like the embodiment of FIG. 8, in use, the power generation system 132 of FIGS. 9 and 10 harvests energy from production fluid flow, or a portion or fraction thereof, and uses that energy produce, or converts the energy to, electrical current.

However, in this configuration, while the retrieval mechanism, e.g., the fishing profile 142, and connector 152 are disposed in the side pocket 130, the generator or turbine 134 is disposed in the main bore of the tubing 18 (e.g., the main bore of a side pocket mandrel 2). The generator 134 can be disposed in a portion of the main bore radially inward and aligned with the side pocket 130, or in a portion of the main bore offset from the side pocket 130 along the longitudinal axis of the tubing 18, for example, in a larger bore below or downhole of the side pocket 130. The power generator 134 is disposed in a housing. An outer diameter of the housing is significantly smaller than a diameter of the main bore, such that only a portion or fraction of the production fluid flows through the turbine. In some configurations, this configuration can accommodate a larger turbine.

Figure 11:
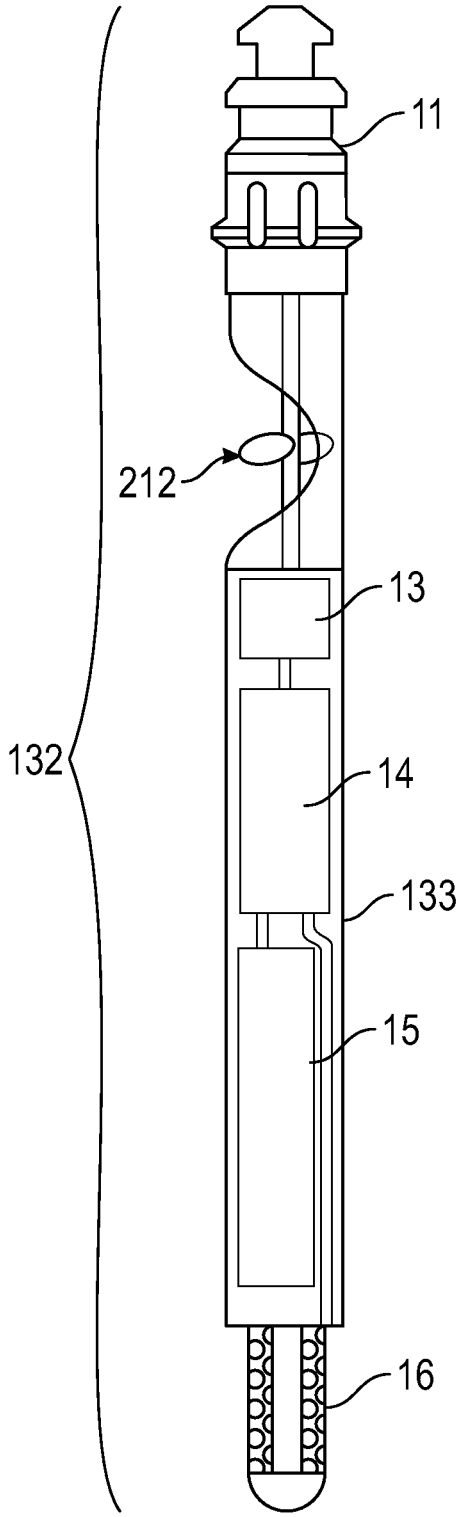
FIG. 11 illustrates an example retrievable power generation system.

FIG. 11 illustrates an example embodiment power generation system 132. The power generation system 132 of FIG. 11 can be used in any of the systems and methods described or shown herein or otherwise according to the present disclosure. As shown, the power generation system 132 includes an electric generator 13 (such as an alternator), a rotating element 212 (a turbine) having blades actuated by the fluid flow, an electronic board 14, an electric energy storage device 15, which may be a rechargeable battery, a coil 16 (which may act as a primary coil), and a fishing profile, e.g., a wireline lock 11. The generator 13, turbine 212, board 14, and energy storage device 15 can be disposed in a body or housing 133, which is cylindrical in the illustrated configuration.

Figure 12:
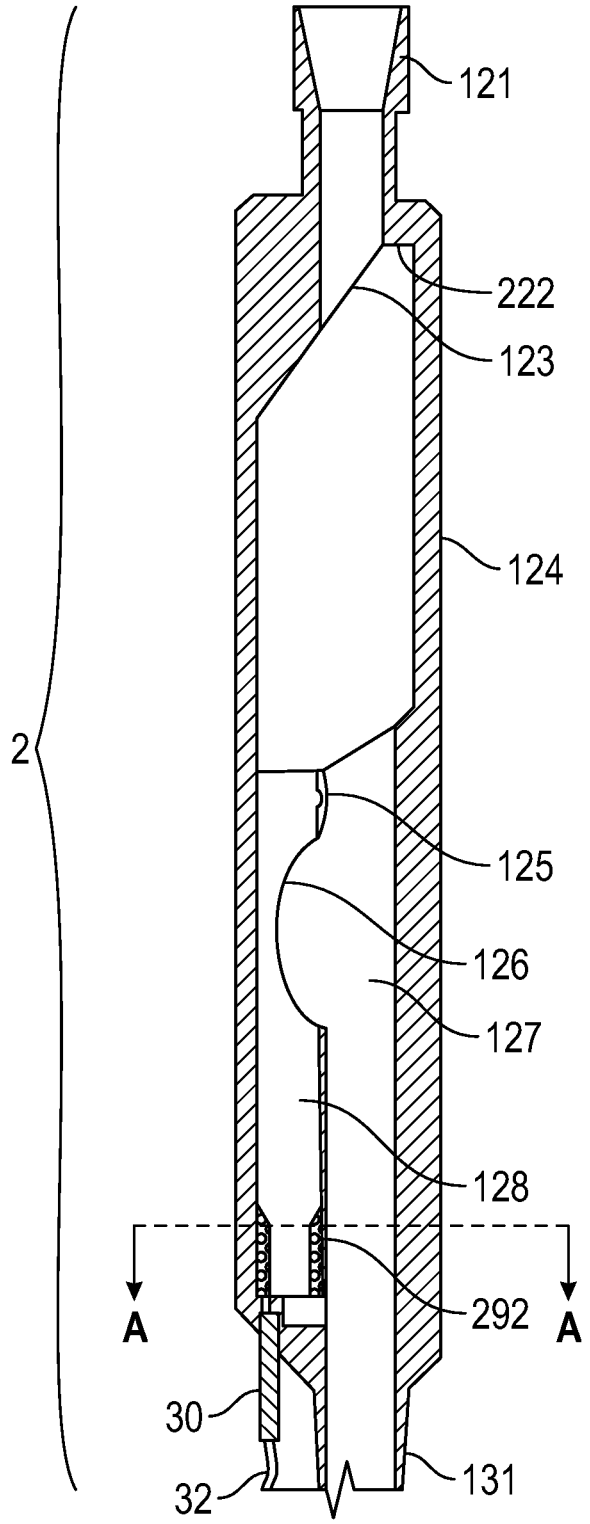
FIG. 12 illustrates an example side pocket mandrel that can house a retrievable power generation system.
Figure 13:
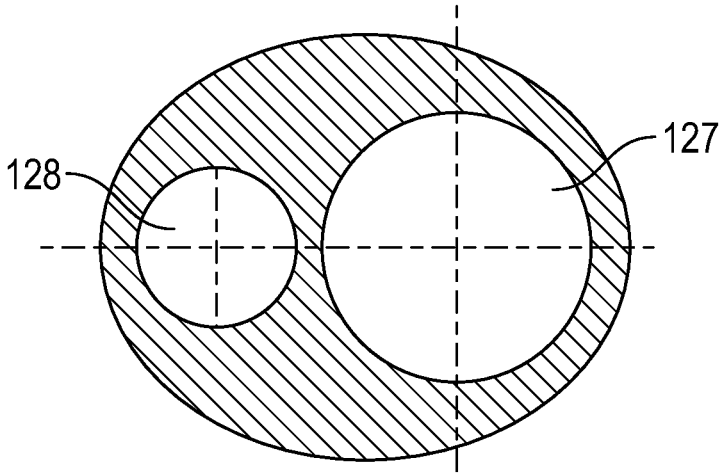
FIG. 13 illustrates a section view of the side pocket mandrel of FIG. 12, taken along line A-A shown in FIG. 12.

FIG. 12 illustrates an example of a side pocket mandrel 2 that can be used in any of the systems and methods described or shown herein or otherwise according to the present disclosure, for example, to house a power generation system such as the power generation system 132 shown in FIG. 11. The side pocket mandrel 2 is installed in the production tubing string 18. The side pocket mandrel 2 has an elongated cylindrical or oval body 124 having or defining a main bore 127 and an offset pocket bore 128 (which can correspond to side pocket 130 shown and described herein). The top and bottom of the body 124 include male-female threads 121, 131 (respectively), which allow the side pocket mandrel 2 to be incorporated into the completion string between two tubing elements.

As shown, a wall of the side pocket 130 includes a large opening 126 to allow a portion of the effluent stream to flow from the main bore 127 into and along the pocket bore 128 and power generation system 132 when installed in the pocket bore 128. The side pocket mandrel 2 includes an electric connector (which can correspond to or functionally couple with connector 152 shown in, for example, FIGS. 7-8). The connector can be or include an inductive coupler and/or a wet connector. In the illustrated configuration, the connector is positioned at or near the bottom of the side pocket 130 of the side pocket mandrel 2.

Figure 14:
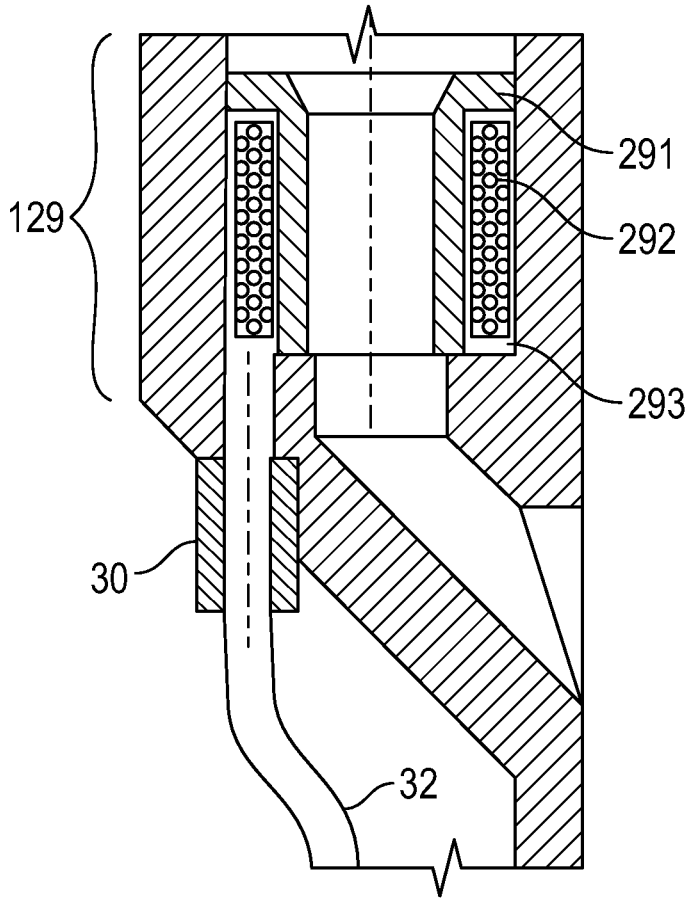
FIG. 14 illustrates an example inductive coupler connector.
Figure 18A:
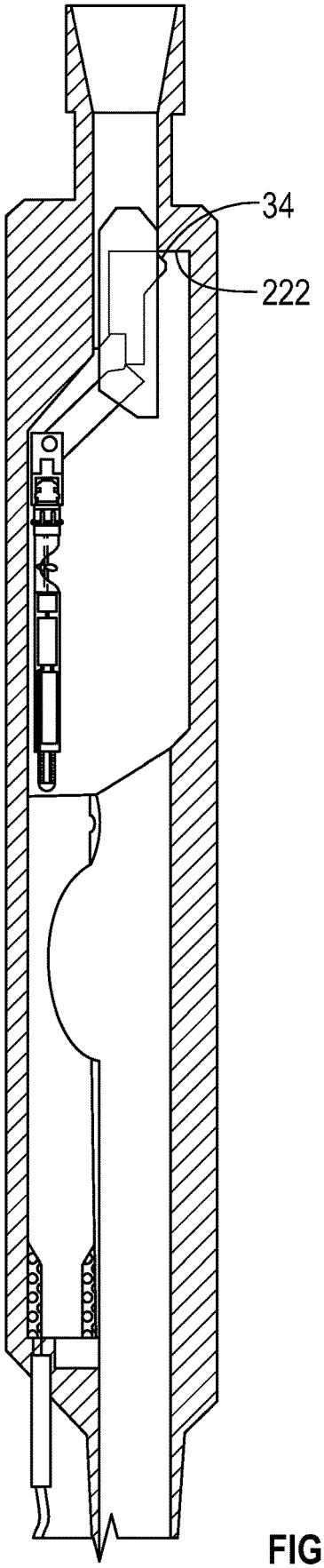
FIGS. 18A and 18B illustrate installation of the power generation system of FIG. 11 in the side pocket mandrel of FIG. 12.
Figure 18B:
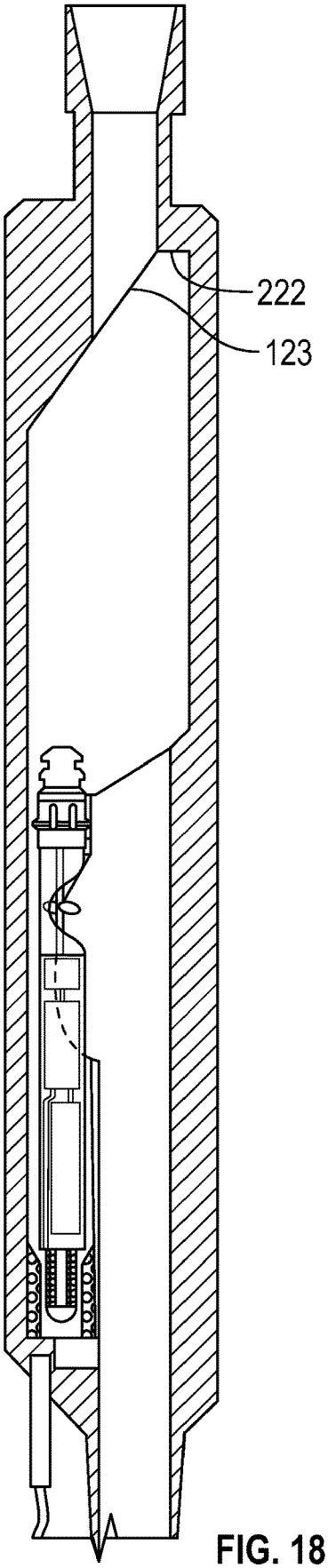

FIGS. 12 and 14 illustrate a configuration of the side pocket mandrel 2 in which the connector is a secondary coil 292 of an inductive coupler 129. The secondary coil 292 is disposed in an annular atmospheric chamber 293. The chamber 293 is at least partially defined by a tube 291 as shown in FIG. 14. The tube 291 can be made of a magnetic alloy. In the illustrated configuration, the tube 291 has an L-shaped or T-shaped configuration. Both ends of the tube 291 are welded to or in the side pocket 130. A thickness of the tube 291 is selected to resist internal pressure of the well. When the power generation system 132 is positioned in the side pocket 130, as shown in FIG. 18B, the coil 16 (i.e., the primary coil) of the power generation system 132 (shown in, e.g., FIG. 11) is disposed concentrically within and with the secondary coil 292. In use, an electro-magnetic field links the coil 16 and the secondary coil 292 through the magnetic tube 291. The inductive coupler 129 pair then acts as a transformer to transfer electric power from the power generation system 132 to outside the side pocket mandrel 2. This arrangement can advantageously provide improved or optimized sealing between the inside (tubing) and outside (annular) of the completion and can prevent electric contact that could jeopardize long-term reliability. The small diameter of the coil 16 and use of a premium alloy in the tube 291, which allows for a small thickness of the tube 291, can advantageously allow the gap between the coils 16, 292 to be small, which can improve the efficiency of the inductive coupler 129.

Figure 15:
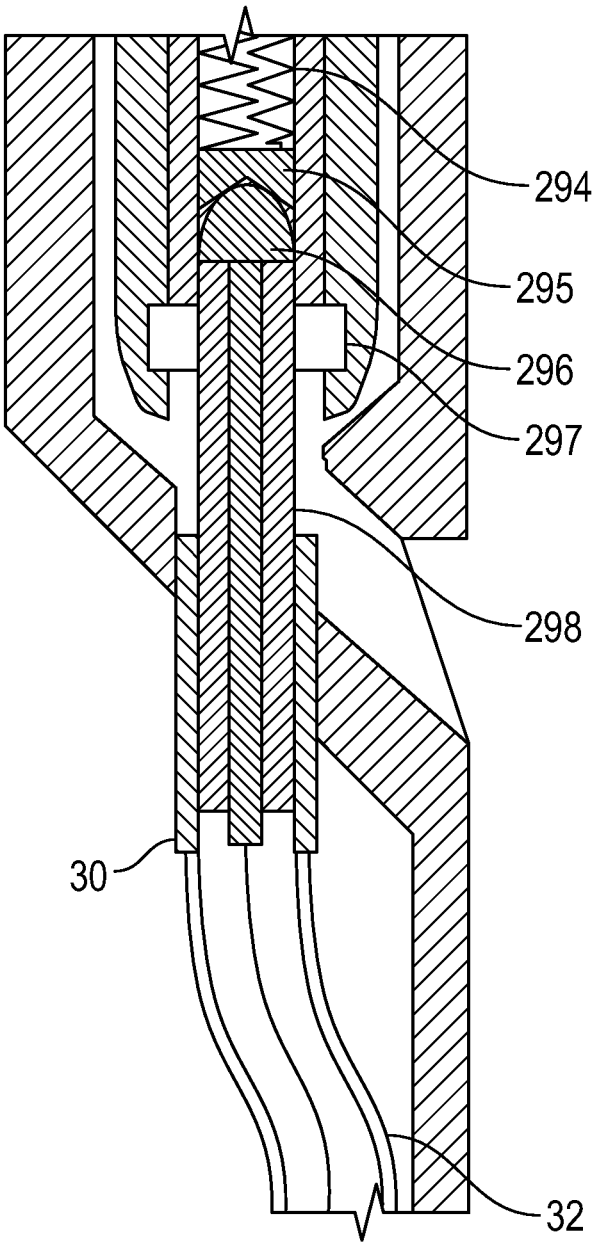
FIG. 15 illustrates an example wet connector.

FIG. 15 illustrates an alternative configuration in which the connector is a wet mate connector. In this configuration, the power generation system 132 includes a female contact 295 energized by a spring 294 and protected by grease during installation. The female contact 295 and spring 294 are disposed in a chamber closed by a shearable disk 297. The disk 297 can be made of rubber or plastic. The side pocket 130 includes a male contact 296 disposed on top of an isolating tube 298. During installation of the power generation system 132 in the side pocket 130, the male contact 296 shears the disk 297 and enters the chamber (which contains grease) until the male contact 296 reaches and/or contacts the female contact 295. The wet connector can be welded and/or equipped with metal seals to provide long-term reliability of the seal(s). The use of a wet connector can advantageously reduce costs. The wet connector advantageously does not require electronics and offers improved or optimized power transmission efficiency.

In both the configuration of FIG. 14 including an inductive coupling and FIG. 15 including a wet connector, an electric cable 32 connects the power generation system 132 to device(s) outside the side pocket mandrel 2. The electric cable 32 is connected, physically and/or electrically, to the inductive coupler 129 (e.g., the secondary coil 292) or the male contact 296 and extends outside of the side pocket mandrel 2. The cable 32 can be used to power an external sensor. The cable head 30 provides improved or optimized sealing. The sealing is often accomplished with metal conical seals, and the cable 32 is encased in a stainless steel tube for long term reliability. The electric contacts and/or the inside of the tube can be in an atmospheric dry chamber or can be filled with a dielectric oil to reduce differential pressure on the seals.

Figure 16:
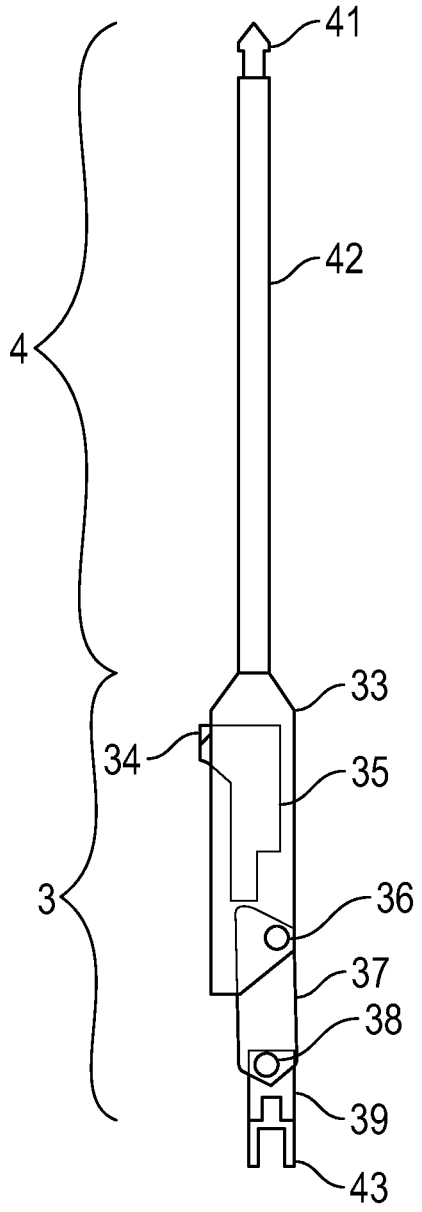
FIG. 16 illustrates an example kick-over tool.

The power generation system 132 can be installed in or retrieved from the side pocket mandrel 2 with a kick-over tool ("KOT") 3 in a wireline operation, as shown in FIGS. 16-18B. As shown in FIG. 16, the KOT 3 is installed on or under a wireline string 4 including a rope socket 41 and weight bars 42. The KOT 3 includes a body 33 and an articulated arm 37. A plunger 35 including a finger 34 is disposed in the body 33. The finger 34 is pushed or biased out of the body 33 by a spring. The arm 37 can be locked in two positions, straight as shown in FIGS. 16 and 17A and bent as shown in FIG. 17B. The arm 37 can be locked with an indexer including a ball and spring. A running tool 43 can be attached (e.g., screwed) to the bottom end of the arm 37 to install the power generation system 132 in the side pocket mandrel 2. A pulling tool can be attached to the bottom end of the arm 37 to retrieve the power generation system 132 from the side pocket mandrel 2.

Figure 17A:
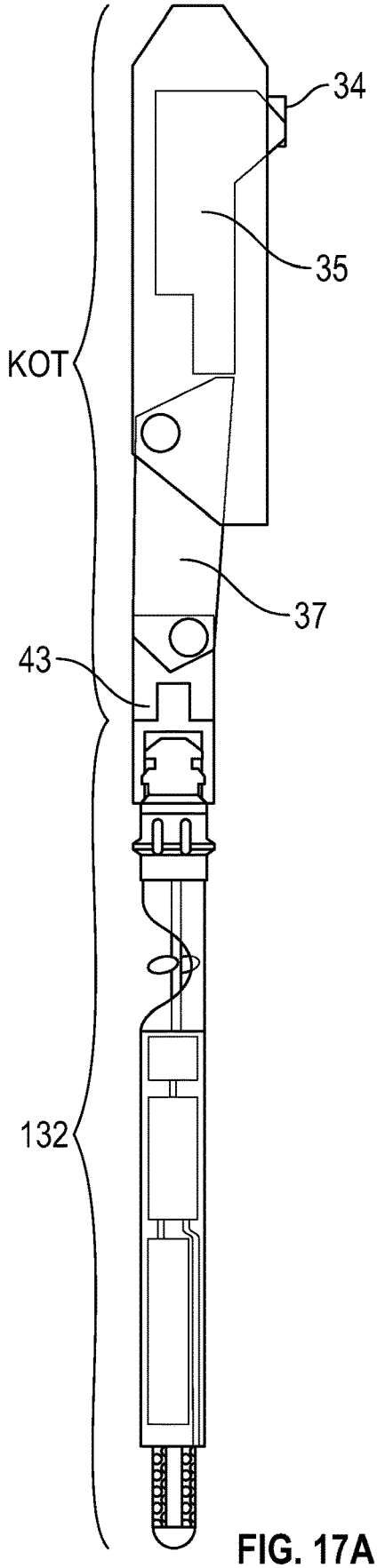
FIGS. 17A and 17B illustrate positions to the kick-over tool of FIG. 16 with the power generation system of FIG. 11.
Figure 17B:
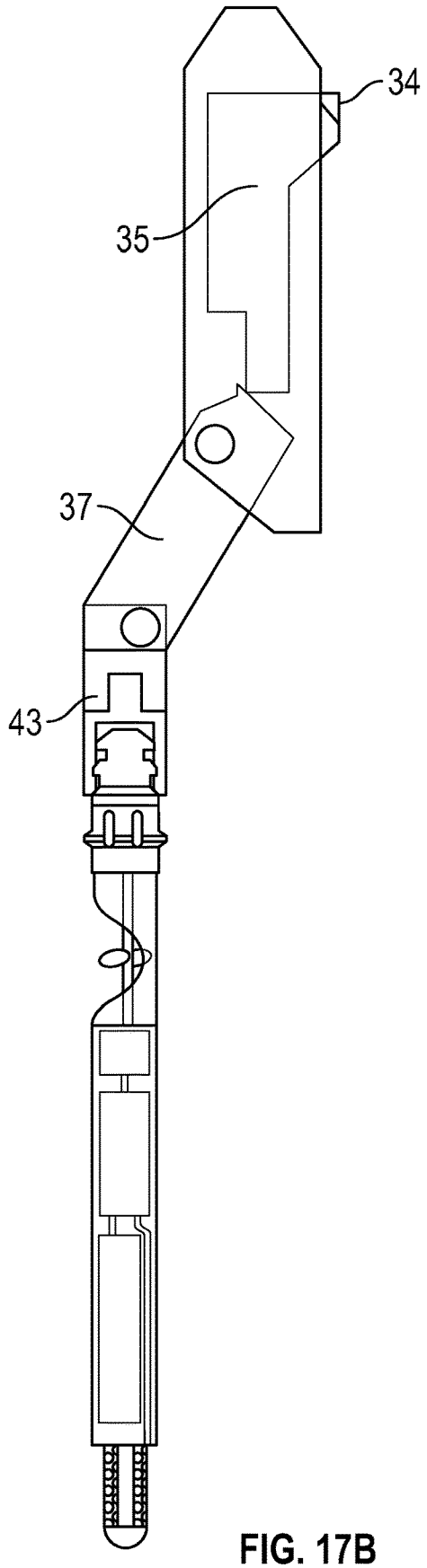

To start installation of the power generation system 132, the plunger 35 is secured in an initial position with a shear pin and the arm 37 is in the straight position, shown in FIG. 17A. When the KOT 3 has been lowered into the side pocket mandrel bore, the finger 34 expands out of the body. The assembly is pulled upward with the wireline 4 until the finger 34 contacts a ramp 123 (shown in FIG. 12) located along an inner top surface of the bore 127 or cavity of the mandrel 2. The assembly rotates as the finger 34 slides along the ramp 123, and the power generation system 132 is positioned close to the side pocket 130. The finger 34 stops against an inner upper shoulder 222 (also shown in FIG. 12) of the mandrel 2, and tension on the wireline 4 forces the arm 37 to the bent position, shown in FIG. 17B. More specifically, with the finger 34 stopped against the shoulder 222, as shown in FIG. 18A, a high tensile load applied on the wireline 4 from the surface shears the pin, and the plunger 35 travels within the body 33, pushing on the arm 37. This causes the arm 37 to pivot, and the indexer locks the arm 37 in the bent position, as shown in FIG. 17B, with the arm 37 positioned just above the side pocket 130. The wireline string 4 is lowered until the power generation system 132 is disposed in the side pocket 130, the coil 16 is disposed in the connector 129, and the lock 11 engages a groove 125 (shown in FIG. 12) in an inner surface of the wall defining the side pocket 130 positioned at or near a top of the side pocket 130. Jarring up with the wireline string 4 shears the pins of the running tool 43 so that the running tool 43 is free to return to the surface, leaving the power generation system 132 in the side pocket, as shown in FIG. 18B. To retrieve the power generation system 132, e.g., for maintenance or replacement, a pulling tool is connected to the arm 37. The pulling tool engages a fishing neck of the lock 11, and jarring up with the wireline string 4 shears pins inside the lock to free the power generation system 132 from the side pocket 130 to return to the surface.

Figure 19:
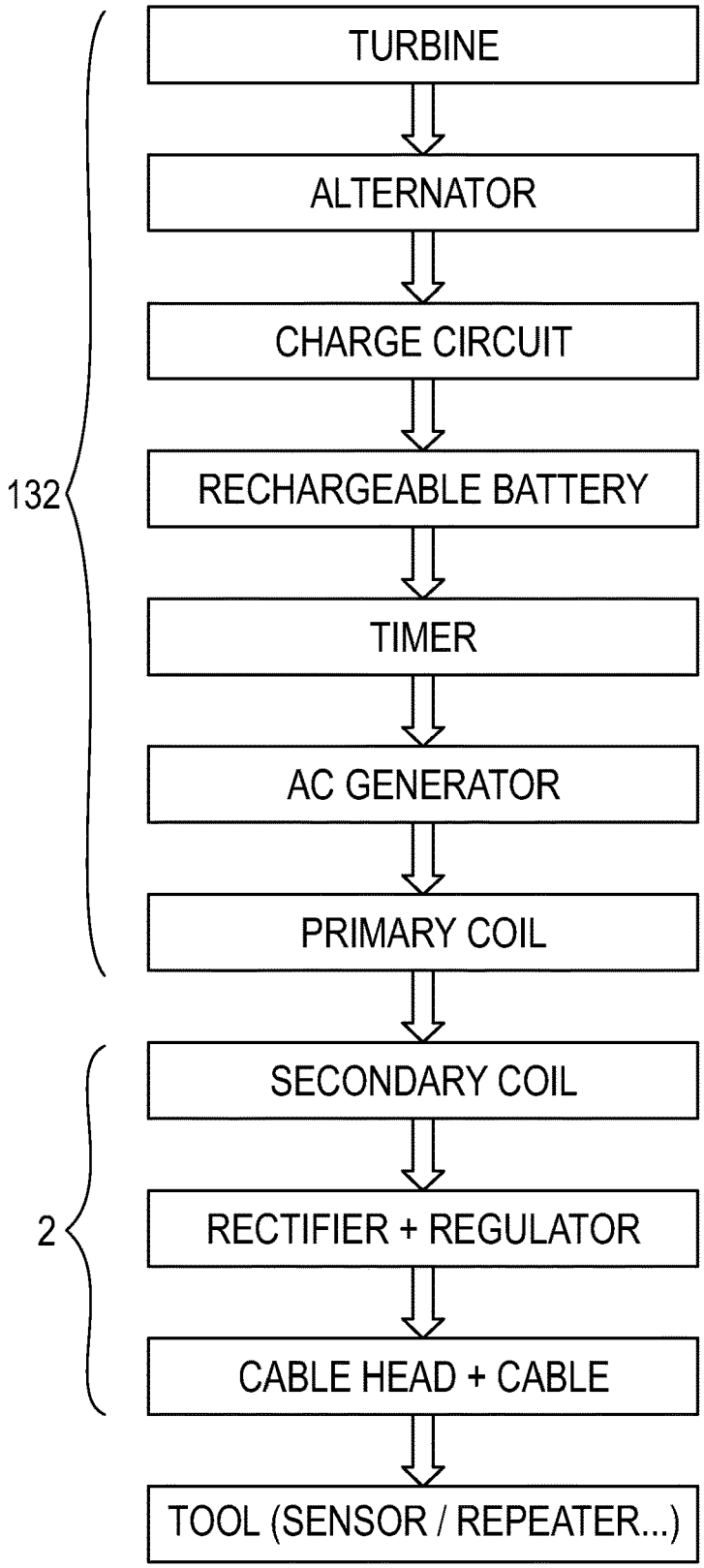
FIG. 19 illustrates a block diagram of operation of the power generation system of FIG. 11.
Figure 20:
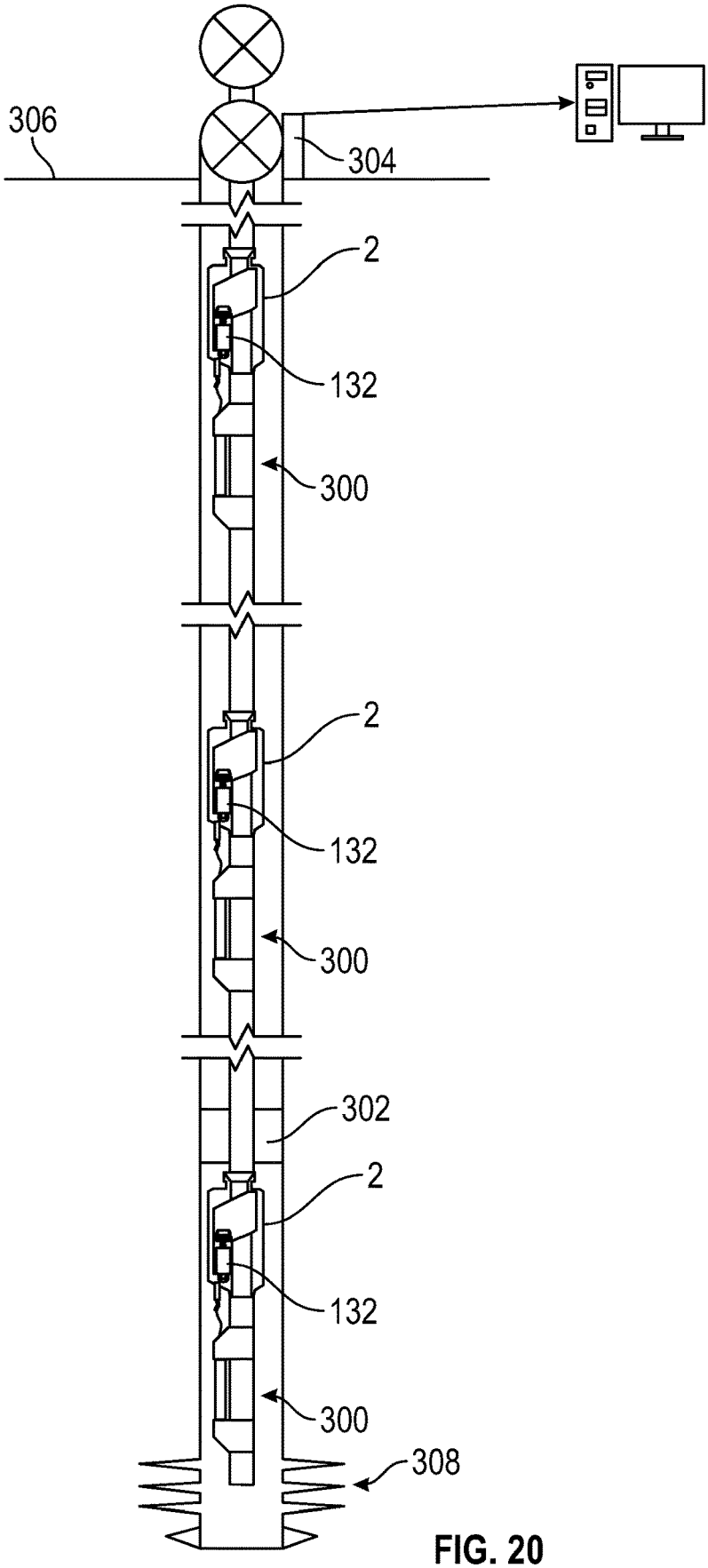
FIG. 20 illustrates an example completion including the power generation system of FIG. 11 in the side pocket mandrel of FIG. 12.

FIG. 19 illustrates a block diagram flow chart of a method of operation of the power generation system 132. In use, oil or gas flow through the well bore rotates the turbine 212, and therefore the alternator 13 attached to the turbine 212. This rotation generates electric energy. A regulator on the electronic board 14 charges the electric storage device 15, e.g., a battery, if needed. When the battery 15 is fully charged, the regulator stops charging the battery 15 to protect the battery 15. The electronic board 14 includes a programmable timer. The timer can operate the inductive coupler 129 (coil 16 and secondary coil 292) for a given time duration, at a specified time or time interval. For example, the timer can be set to operate the inductive coupler 129 for a set number of minutes every 12 hours. During the duration of operation, the electronic board 14 generates an alternating current in the primary coil 16. The inductive coupler 129 acts as a transformer, such that the secondary coil 292 also generates an alternating current that can be converted to a direct current. The cable 32 transfers the current to one or more downhole devices to power the device(s) for the duration of the timer. The downhole device(s) being powered can include, for example, one or more of various types of sensors, acoustic telemetry equipment, acoustic repeater that repeats and amplifies any received acoustic signals, or an electro-magnetic telemetry hub. FIG. 20 illustrates an example of an overall completion including three power generation systems 132 disposed in three side pocket mandrels 2. The completion of FIG. 20 also includes the acoustic repeaters 300. The completion can include one or more sensors or gauges, for example, a pressure temperature gauge, which may be co-located with the bottommost acoustic repeater 300, located proximate perforations 308 in the illustrated configuration. The completion can include one or more packers 302. The completion can include a surface transmitter 304 disposed at the surface 306. Other arrangements and configurations are also possible.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A power generation system comprising:

a housing including a window in a sidewall thereof, the window having a top and a bottom;

a turbine driven by fluid flow, the turbine disposed in the housing adjacent to the window between the top and the bottom;

an alternator driven by the turbine, the alternator configured to convert energy from the fluid flow to electrical energy;

an electrical power storage device configured to be charged by the electrical energy generated from the fluid flow; and a connector configured to transfer power from the power storage device to a device requiring electrical power outside the power generation system;

wherein the power generation system is configured to be removably disposed in a side pocket mandrel in a wellbore.

2. The system of claim 1, wherein the power storage device is a rechargeable battery.

3. The system of claim 2, wherein the connector is an inductive coupler, and wherein when disposed in the wellbore, the rechargeable battery is configured to be charged via inductive charging by a wireline tool including an inductive coupler lowered into the wellbore to a position in which the inductive coupler of the wireline tool is aligned with the inductive coupler of the power generation system.

4. The system of claim 1, wherein the turbine is driven by annulus fluid flow.

5. The system of claim 1, wherein the turbine is driven by a portion of production fluid flow.

6. The system of claim 1, wherein the connector is an inductive coupler.

7. The system of claim 1, wherein the connector is a wet mate connector.

8. The system of claim 1, wherein the power generation system is configured to be disposed in and/or removed from the side pocket mandrel by wireline or slickline.

9. The system of claim 8, further comprising a fishing profile configured to couple to a kick-over tool installed on or in the wireline or slickline string.

10. A side pocket mandrel configured to house a power generation system, the side pocket mandrel comprising:

an elongated body defining a main bore;

an internal wall disposed in the main bore and defining a side pocket having a top opening to the main bore and a bottom opening to the main bore, the side pocket configured to house the power generation system, the internal wall having a side opening between the top opening and the bottom opening configured to allow fluid to flow from the main bore, through the side opening, and along the power generation system in the side pocket; and an electrical connector disposed at a bottom of the side pocket.

11. The side pocket mandrel of claim 10, wherein the electrical connector comprises a coil of an inductive coupling.

12. The side pocket mandrel of claim 11, wherein the coil is configured to inductively couple with a coil of a power generation system disposed in the side pocket in use.

13. The side pocket mandrel of claim 10, wherein the electrical connector comprises a direct physical contact electrical conductor.

14. A system comprising the power generation system of claim 1 disposed in the side pocket of the side pocket mandrel of claim 10.

15. A power generation system comprising:

a housing including a window in a sidewall thereof, the window having a top and a bottom;

a power generator driven by fluid flow and configured to convert energy from the fluid flow to electrical energy, the power generator including a turbine disposed in the housing adjacent to the window between the top and the bottom;

an electrical power storage device configured to be charged by the electrical energy generated from the fluid flow; and a connector configured to transfer power from the power storage device to a device requiring electrical power outside the power generation system;

wherein the power generation system is configured to be removably disposed in a wellbore.

16. The system of claim 15, wherein the connector is a first coil of an inductive coupler pair.

17. A well completion comprising:

a tubing string;

the power generation system of claim 16 disposed within the tubing string; and a second coil of the inductive coupler pair disposed within the tubing string such that the first and second coils of the inductive coupler pair are radially aligned when the power generation system is disposed within the tubing string.

18. The system of claim 15, wherein the power generator is driven by annulus fluid flow.

19. The system of claim 15, wherein the power generator is driven by a portion of production fluid flow.

* * * * *